US010696529B2

(12) United States Patent
Baughman et al.

(10) Patent No.: US 10,696,529 B2
(45) Date of Patent: Jun. 30, 2020

(54) INTERNALLY LOCKING FUNNEL ASSEMBLY FOR CONTAINER WITH PLASTIC PRESS-IN CLOSURE

(71) Applicant: RIEKE CORPORATION, Auburn, IN (US)

(72) Inventors: Gary M. Baughman, Fort Wayne, IN (US); Thomas P. Kasting, Fort Wayne, IN (US)

(73) Assignee: RIEKE LLC, Auburn, IN (US)

( * ) Notice: Subject to any disclaimer, the term of this patent is extended or adjusted under 35 U.S.C. 154(b) by 0 days.

(21) Appl. No.: 16/251,675

(22) Filed: Jan. 18, 2019

(65) Prior Publication Data

US 2019/0233272 A1 Aug. 1, 2019

Related U.S. Application Data

(60) Provisional application No. 62/618,868, filed on Jan. 18, 2018.

(51) Int. Cl.

| | |
|---|---|
| ***B67C 11/02*** | (2006.01) |
| ***B65D 25/48*** | (2006.01) |
| ***B65D 51/24*** | (2006.01) |
| ***B65D 41/04*** | (2006.01) |

(52) U.S. Cl.

CPC ..... *B67C 11/02* (2013.01); *B65D 25/48* (2013.01); *B65D 41/04* (2013.01); *B65D 51/24* (2013.01)

(58) Field of Classification Search

CPC ..... B67C 11/02; B65D 25/48; B65D 41/04; B65D 51/24; B65D 25/50

USPC ..... 222/461

See application file for complete search history.

(56) References Cited

U.S. PATENT DOCUMENTS

| | | | | |
|---|---|---|---|---|
| 2,760,683 | A * | 8/1956 | Diether | B65D 25/48 222/143 |
| D217,180 | S | 4/1970 | Holland | |
| 3,939,884 | A | 2/1976 | Mader | |
| 4,338,984 | A | 7/1982 | Kronberg | |
| 4,664,301 | A * | 5/1987 | Hoyt | B65D 25/50 220/735 |
| 4,706,720 | A | 11/1987 | Pattison | |
| 4,823,238 | A | 5/1989 | Taylor | |
| D307,173 | S | 4/1990 | Boehnke | |
| 5,101,870 | A | 4/1992 | Farris | |
| 5,937,920 | A | 8/1999 | Simmel | |
| 6,155,315 | A | 12/2000 | Peterson | |
| 6,209,595 | B1 | 4/2001 | Granath | |
| 6,260,590 | B1 | 7/2001 | Ziegmann | |
| 6,397,907 | B1 | 6/2002 | Heintz | |
| 6,752,183 | B2 | 6/2004 | Leoncavallo | |
| 7,264,027 | B2 | 9/2007 | Rosenbaum | |
| D560,105 | S | 1/2008 | McKenzie | |

(Continued)

*Primary Examiner* — Benjamin R Shaw

(74) *Attorney, Agent, or Firm* — McDonald Hopkins LLC

(57) ABSTRACT

A system for closing a container is contemplated. The system features an injection molded, polymeric funnel including an engagement flange and a connector piece attaching to a gripping ring. A closure body capable of sealing a container is also provided. The closure includes a pull tab to create an opening into which the funnel inlet may be received in a snap-fitting arrangement. The engagement flange and protrusions proximate to the end of the funnel inlet facilitate the snap fit, align the structure, and prevent over-insertion of the funnel into the interior volume of the container.

6 Claims, 7 Drawing Sheets

(56) References Cited

U.S. PATENT DOCUMENTS

| | | | | |
|---|---|---|---|---|
| 7,464,735 | B2 | 12/2008 | Shultz | |
| 7,665,492 | B2 | 2/2010 | Burstein | |
| 7,886,782 | B1 | 2/2011 | Curtis | |
| 7,975,734 | B2 | 7/2011 | Makowiec | |
| 8,469,066 | B2 | 6/2013 | Castillo | |
| 8,875,754 | B2 | 11/2014 | Eyre | |
| D740,085 | S | 10/2015 | Baughman | |
| 9,266,707 | B2 | 2/2016 | Baker | |
| 9,346,658 | B2 | 5/2016 | Baughman | |
| 9,392,755 | B1 | 7/2016 | Lantis | |
| D772,025 | S | 11/2016 | Salzl | |
| D783,209 | S | 4/2017 | Morris | |
| 2002/0074247 | A1 | 6/2002 | Tremblay | |
| 2004/0232175 | A1* | 11/2004 | deCler | B65D 5/746 222/567 |
| 2005/0077322 | A1 | 4/2005 | Graybill | |
| 2006/0185763 | A1 | 8/2006 | Rosenbaum | |
| 2008/0023103 | A1 | 1/2008 | Brandon | |
| 2009/0107582 | A1 | 4/2009 | Sayage | |
| 2009/0188583 | A1 | 7/2009 | Noel | |
| 2009/0242432 | A1 | 10/2009 | Grebe | |
| 2013/0175237 | A1* | 7/2013 | Parks, Jr. | B65D 88/26 215/386 |
| 2014/0034687 | A1* | 2/2014 | Evans | B65D 47/068 222/538 |
| 2014/0137985 | A1 | 5/2014 | Zitkovic | |
| 2014/0174602 | A1 | 6/2014 | Baker | |
| 2015/0068643 | A1* | 3/2015 | Baughman | B67C 11/02 141/332 |
| 2015/0173540 | A1* | 6/2015 | Albers | B65B 3/045 220/715 |
| 2015/0246759 | A1* | 9/2015 | Testa | B65D 25/48 222/522 |
| 2016/0272371 | A1* | 9/2016 | Crosby | B65D 25/48 |

* cited by examiner

INTERNALLY LOCKING FUNNEL ASSEMBLY FOR CONTAINER WITH PLASTIC PRESS-IN CLOSURE

CROSS REFERENCE TO RELATED APPLICATIONS

This application claims priority to U.S. provisional patent application 62/618,868 filed on Jan. 18, 2018, which is incorporated by reference herein.

TECHNICAL FIELD

The present invention relates generally to a funnel dispenser and, more specifically, to a selectively attachable funnel with reduced taper that is carried integrally on a container.

BACKGROUND

Many container designs provide for a funnel or spout to simplify the process of transferring liquids carried in that container to some other desired location. The need for such designs is particularly acute in the automotive area, where fuel additives, oil, lubricants, and/or other viscous liquids must frequently be delivered into vertically oriented ports of a defined size. Thus, by including a spout or funnel, the user can direct the flow and leave the arrangement in an inverted position for an extended period of time to ensure the entire amount of liquid is transferred.

One design for such a funnel and container arrangement is shown in U.S. Pat. No. 9,346,658. Here, an injection-molded unitary funnel has a narrowing, tapered cylinder terminating in a flared skirt proximate to the outlet. The taper is between 1-2 degrees, and the flared skirt is necessary to ensure the funnel has sufficient diameter for use with capless gas tanks. At the proximal end of the funnel (i.e., the end opposite the outlet/skirt), a threaded connection allows the funnel to be screwed onto a corresponding, tapped facing of the container. U.S. Pat. Nos. 4,823,238 and 9,266,707 also shows a similar, threaded funnels for attachment to a container.

U.S. Pat. No. 5,101,870 discloses a conical funnel that is carried on the top exterior of similarly shaped container. Here, the funnel conforms to the container but does not necessarily attach or engage the container when the container is being emptied.

Other telescoping or collapsible funnels, attached to or integral with containers are also well known within this field, e.g., U.S. Pat. No. 7,264,027. These funnels must be expanded prior to use, and they may be prone to inadvertent collapsing/telescoping during use.

All of the aforementioned patent publications are incorporated by reference to provide further context for the background of this invention.

One particular issue with any of the aforementioned designs relates to the lubricating nature of many fuels, additives, and the like. As a container is emptied, these liquids tend to facilitate unwanted rotation of the funnel, especially in instances where the mass of the inverted container and/or inadvertent user interactions create rotary force. In turn, this force can cause unwanted spills due to partial or complete separation of the funnel from the container.

SUMMARY

A system for closing a container is contemplated. The system features an injection molded, polymeric funnel having only a slight taper of less than 1.0 degrees and, more preferably, of approximately 0.5 degrees (all relative to vertical) and straight exterior sidewalls extending to the funnel's outlet. Proximate to the funnel's inlet, an engagement flange and flexing notch are provided, along with a connector piece attaching to a gripping ring. The gripping ring creates an interference fit with the container neck so as to hold together the funnel and container combination.

As final aspect of the system, a closure body is sized to fit concentrically within an opening formed on the container neck. The closure body forms a seal but a includes a pull tab, removable foil, or other similar structure to allow a user to create an opening. The opening is sized to receive the funnel inlet in a snap-fitting arrangement with at least one protrusion or flange on the inlet edge of the funnel capturing a cooperating internal surface of the closure. The engagement flange rests on a top edge of the opening to align the snap-fit structure and prevent over-insertion of the funnel into the interior volume of the container. One or more notches may be provided around the circumference of the funnel at its terminal inlet edge so as to allow sufficient flexibility upon insertion and engagement of the inlet to the container neck.

One aspect of the invention may include any combination of the following features:

- a tapered, elongated hollow tube having an inlet at one end and an outlet with a defined outer diameter at an opposing end;
- a closure body sized to seal an opening on the container and having a removable section, wherein the removable section, when separated from the closure body, exposes a through-channel to receive the inlet of the hollow tube;
- a connector attachable to the hollow tube proximate to the opening on the container;
- wherein the connector includes a gripping ring;
- wherein the gripping ring encircles the opening of the container to secure the hollow tube thereto;
- wherein the gripping ring includes a plurality of engagement teeth disposed on an inner surface of the engagement ring;
- wherein the hollow tube includes smooth surfaces devoid of any threads along an inner and outer surface of the inlet;
- wherein the hollow tube includes straight surfaces devoid of any flanges or skirts on an outer surface of the outlet;
- wherein the inlet includes an engagement flange disposed along an outer surface of the hollow tube;
- wherein the inlet includes at least one snap-fitting protrusion, said protrusion engaging the through-channel to secure the hollow tube to the closure body;
- wherein the taper of the hollow tube is between 0.5 and 3.0 degrees relative to a vertical axis of the hollow tube;
- wherein the hollow tube includes straight surfaces completely throughout an inner facing surface of the hollow tube;
- wherein the hollow tube includes straight surfaces completely throughout an inner facing surface of the hollow tube; and
- wherein an inner facing of the through-channel includes a locking bead to engage the snap-fitting.

Specific reference is made to the appended claims, drawings, and description below, all of which disclose elements of the invention. While specific embodiments are identified, it will be understood that elements from one described aspect may be combined with those from a separately identified aspect. In the same manner, a person of ordinary skill will have the requisite understanding of common processes, components, and methods, and this description is intended to encompass and disclose such common aspects even if they are not expressly identified herein.

DESCRIPTION OF THE DRAWINGS

Operation of the invention may be better understood by reference to the detailed description taken in connection with the following illustrations. These appended drawings form part of this specification, and any information on/in the drawings is both literally encompassed (i.e., the actual stated values) and relatively encompassed (e.g., ratios for respective dimensions of parts). In the same manner, the relative positioning and relationship of the components as shown in these drawings, as well as their function, shape, dimensions, and appearance, may all further inform certain aspects of the invention as if fully rewritten herein. Unless otherwise stated, all dimensions in the drawings are with reference to inches, and any printed information on/in the drawings form part of this written disclosure. Also, the objects in the drawings are shown in their intended orientation, so that a feature shown in the top of the drawings are oriented toward the upper or topside portion of the mechanism/object, while features at or facing downward likewise at the bottom or underside portion.

In the drawings and attachments, all of which are incorporated as part of this disclosure.

DETAILED DESCRIPTION

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Figure 1:
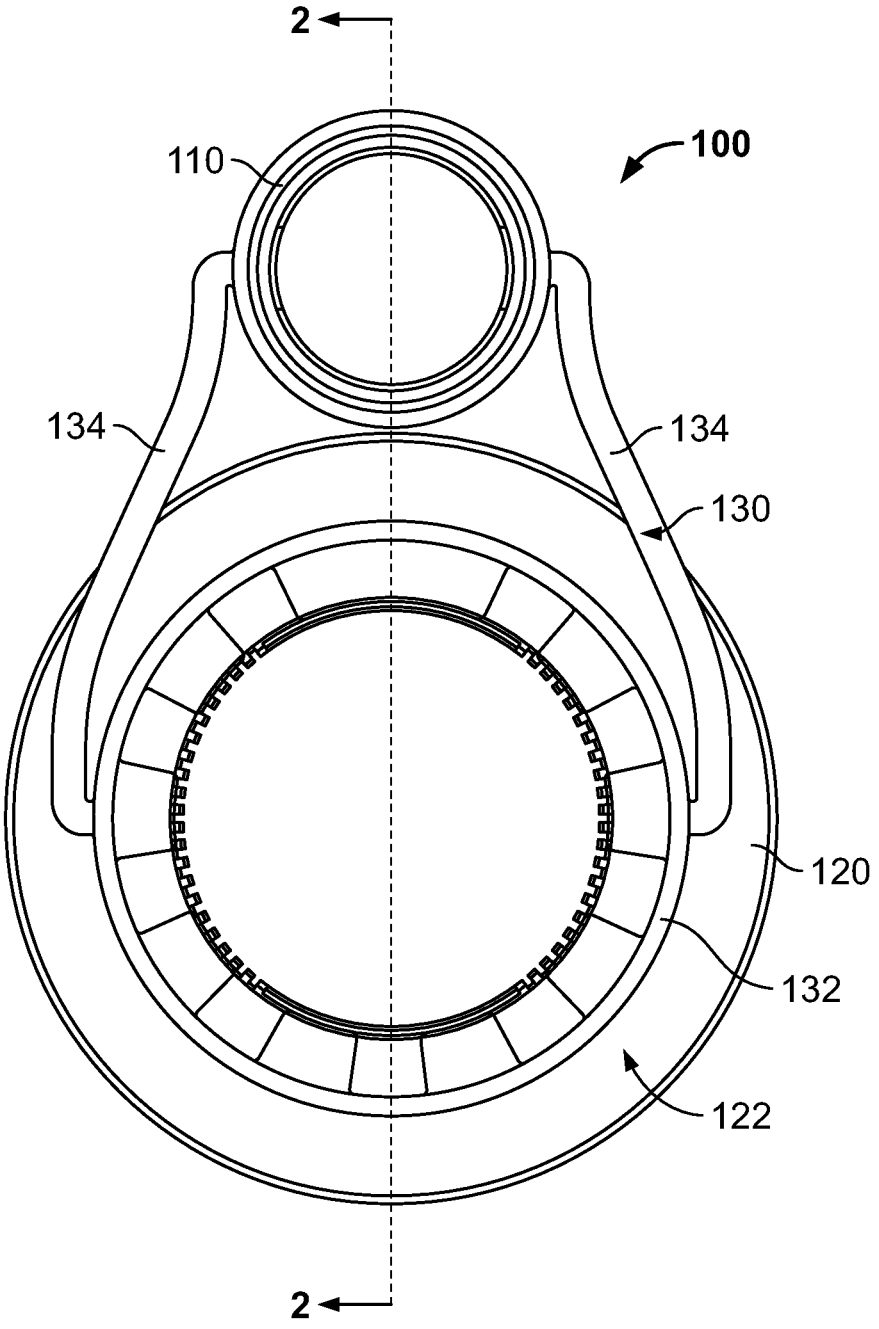
FIG. 1 is a top view of the funnel, closure body, and container in an aspect of the invention where the funnel is in its transportable position
Figure 2:
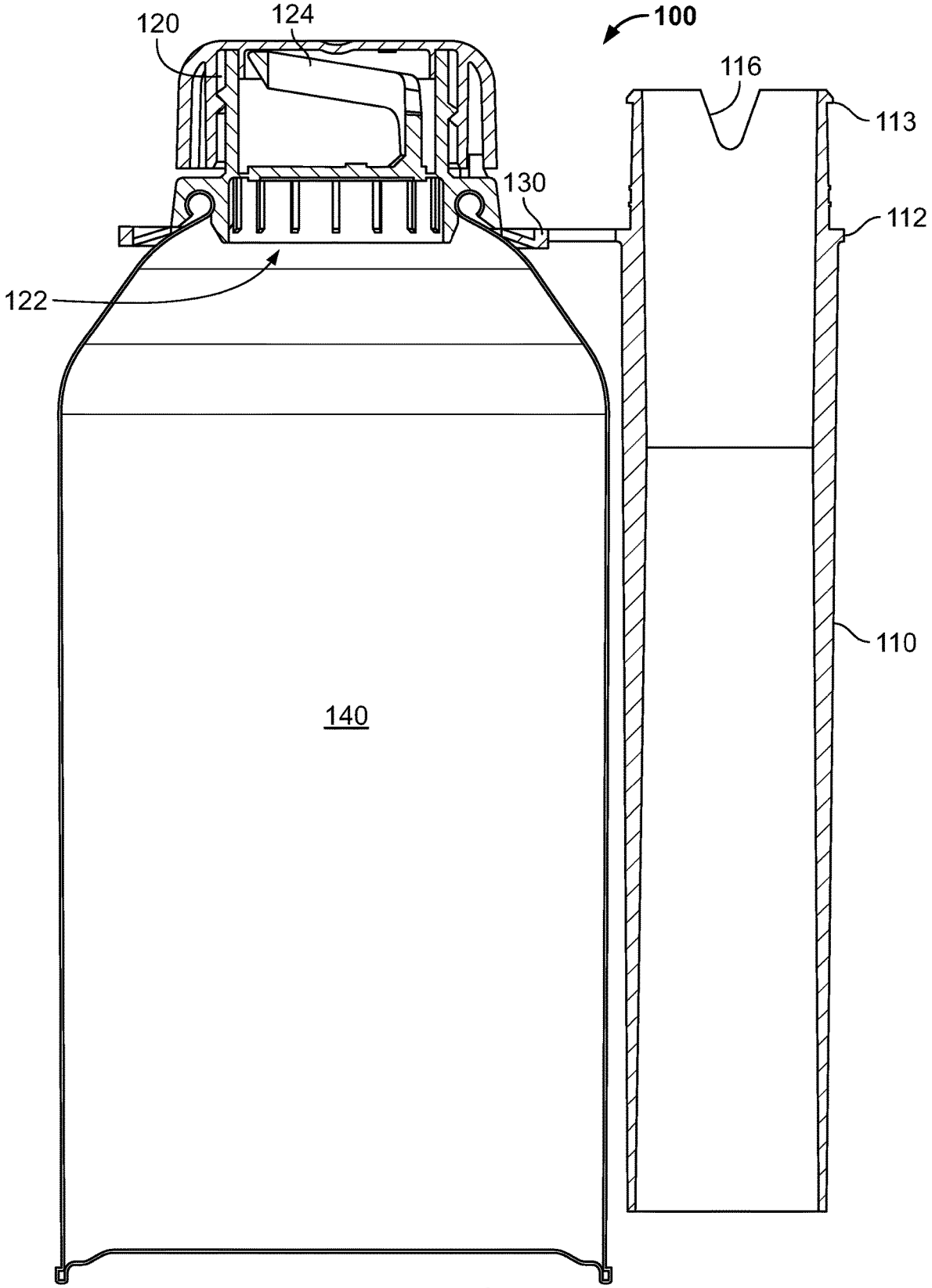
FIG. 2 is cross sectional side view, taken along line 2-2 from FIG. 1, of the funnel and closure body attached to the container.
Figure 3:
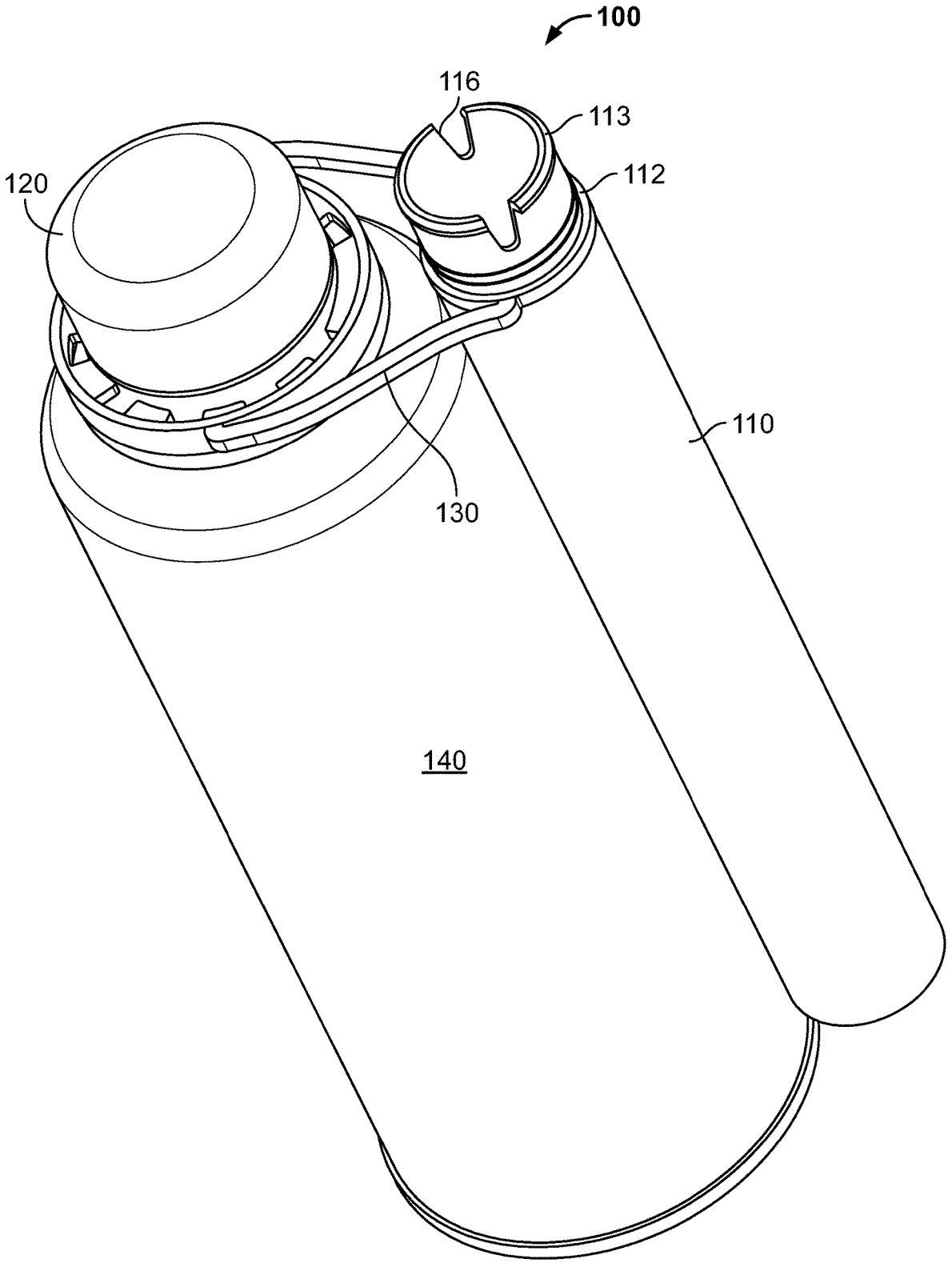
FIG. 3 is a perspective view of the embodiment of FIGS. 1 and 2.
Figure 4:
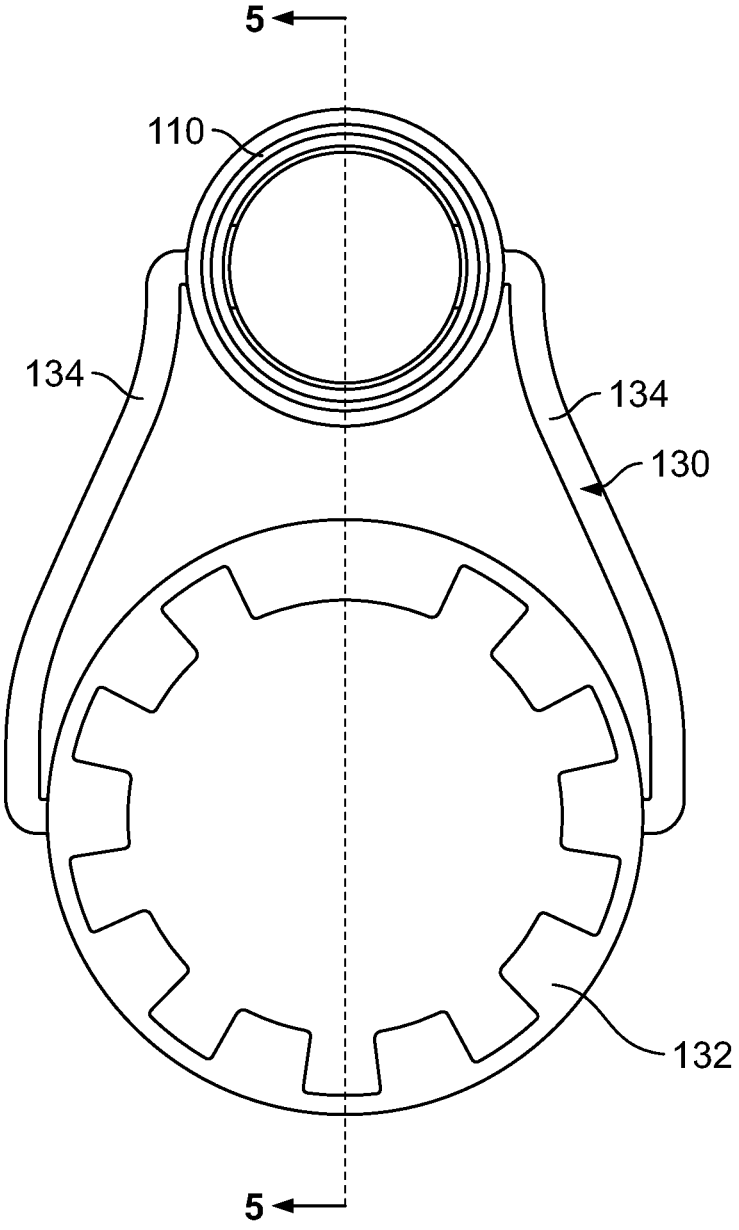
FIG. 4 is a top view of the funnel, connector, and gripping ring isolated from the closure and container.
Figure 5:
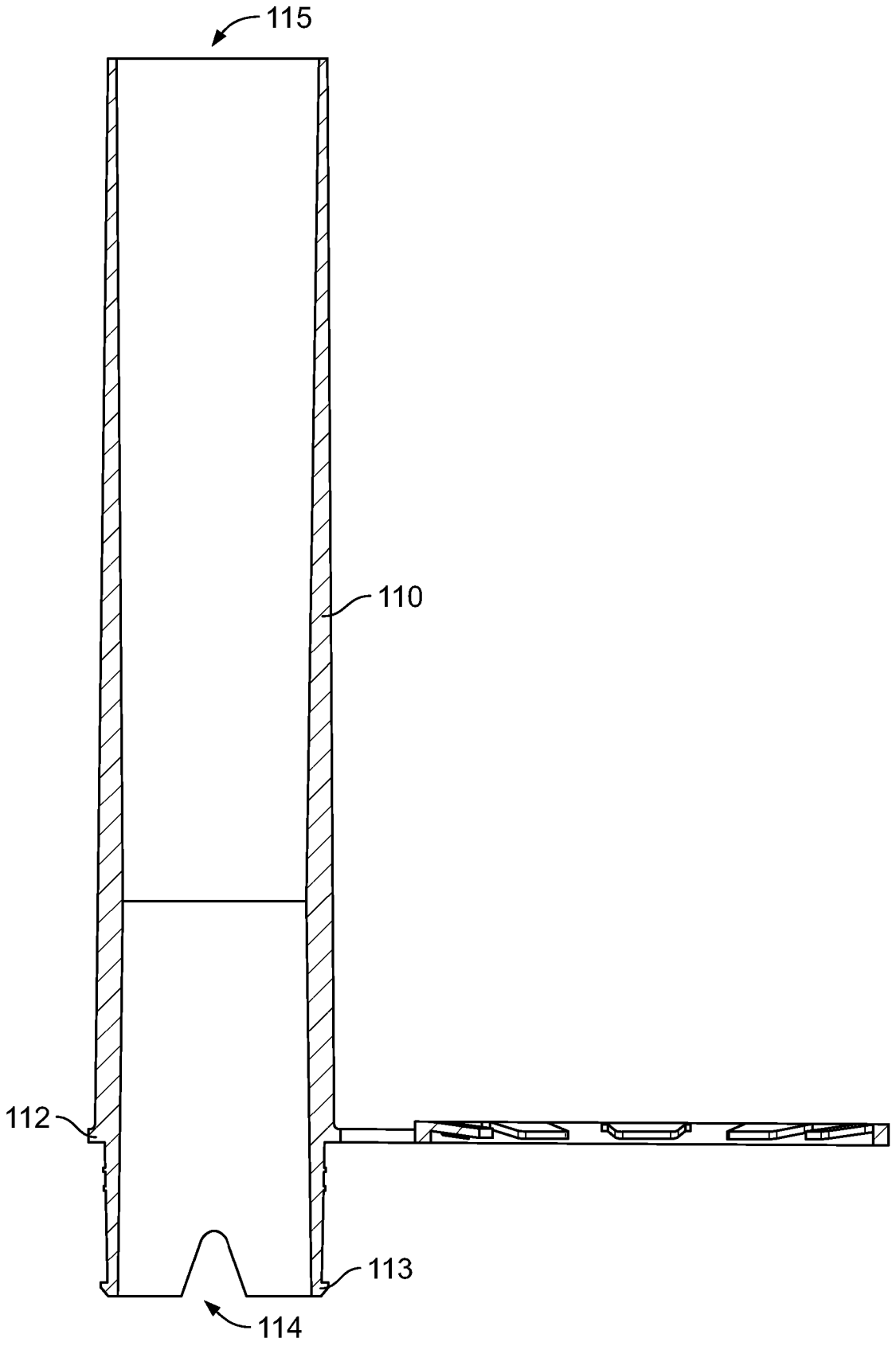
FIG. 5 is a cross sectional view, taken along line 5-5 from FIG. 4, of the funnel, connector, and gripping ring.
Figure 6:
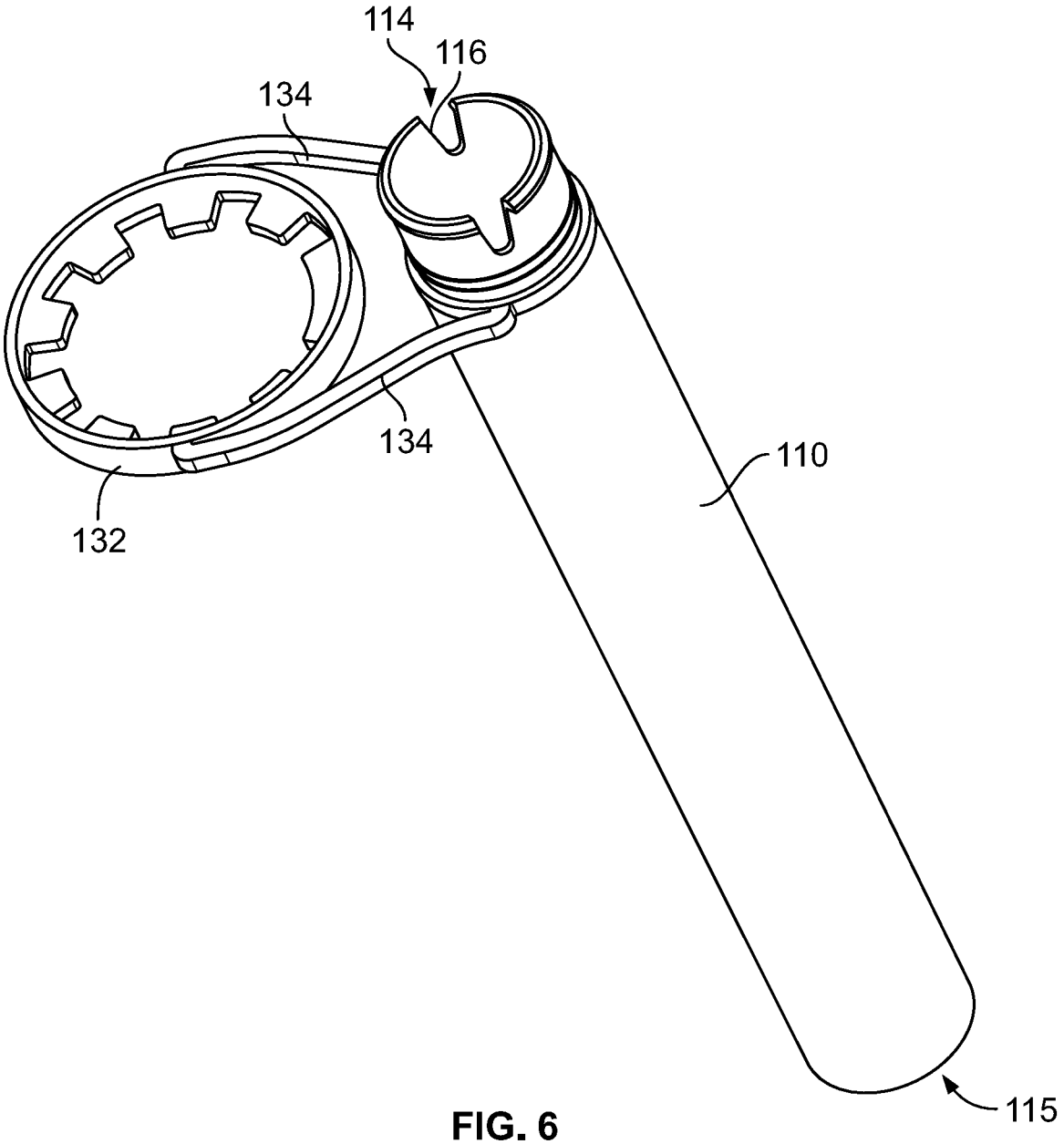
FIG. 6 is a perspective view of the embodiment of FIGS. 4 and 5.
Figure 7:
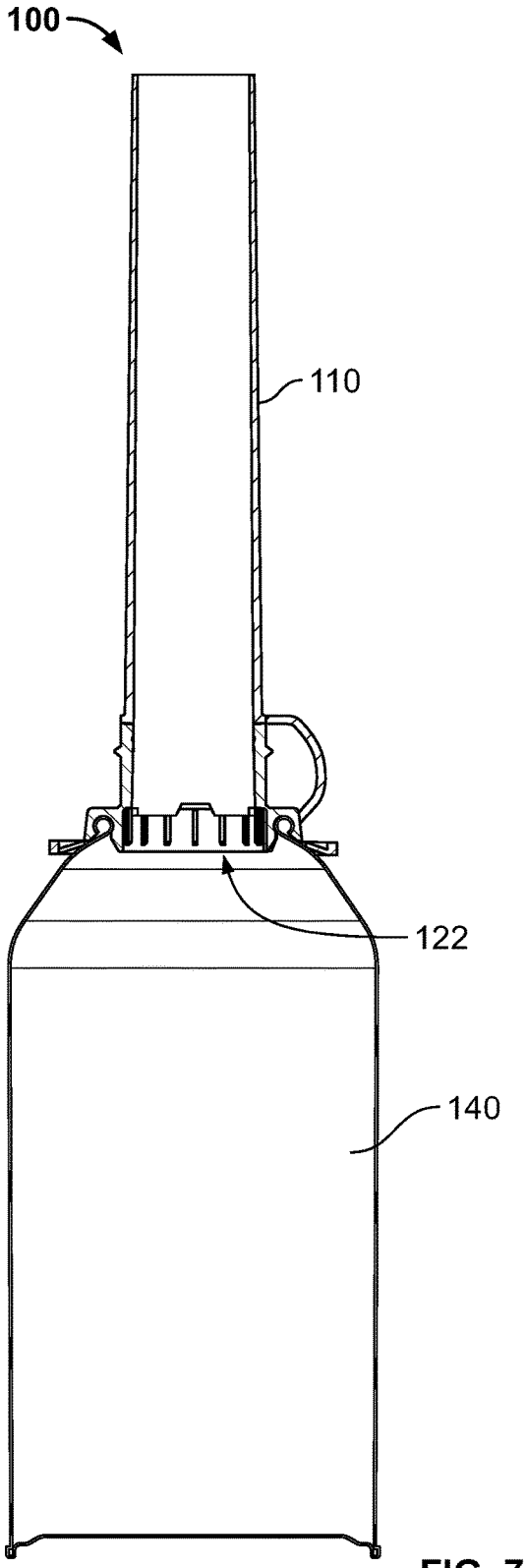
FIG. 7 is cross sectional side view, taken along line 2-2 from FIG. 1, of the funnel attached to the closure body and container with the covering removed to create a through-hole for emptying liquid out of the container via the funnel.
Figure 8:
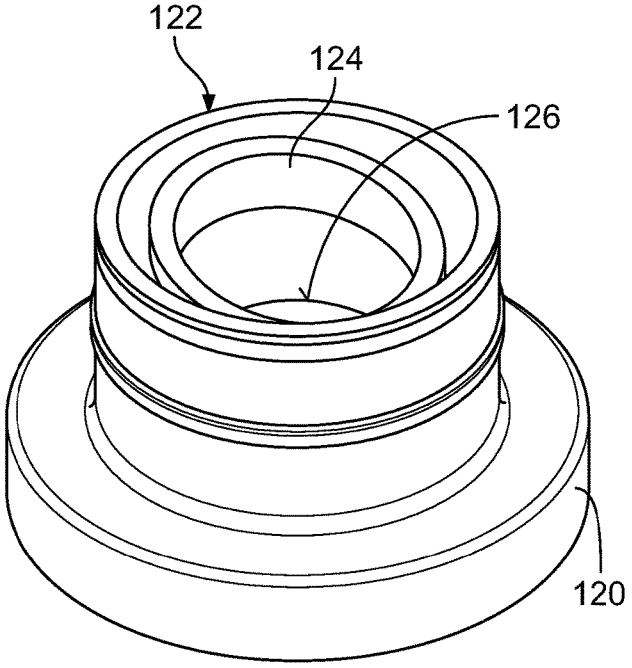
FIG. 8 is a perspective, sectional view of the closure body in isolation with the removal covering and pull ring still intact.

With reference to FIGS. 1 through 7, a snap-fitting funnel assembly is disclosed. The assembly 100 includes an elongated, hollow tube 110 which may serve as the funnel. The tube preferably has smooth inner and outer surfaces along the entirety of its length, excepting for a peripheral engagement flange 112 on the exterior and at least one snap-fitting 113, such as one or more protrusions or nubs. Flange 112 and protrusion(s) 113 are positioned proximate to the inlet 114. Notably, inlet 114 is devoid of any skirt, flared portion, or flange, as the diameter of the outlet 115 is preformed to correspond with a standardized size, such as the diameter of capless gas tank systems.

Snap-fitting(s) 113 cooperate to engage an opening or through-hole 122 associated with the closure body/container 120. In particular, the protrusions are formed to have sufficient resilience to pass through the opening and create a snap fit with corresponding structure on the inner surface (or an edge) of that opening. That is, the through-hole formed on the container provides sufficient compressive force against the protrusions and the inlet of the hollow tube to create a sufficient seal.

In this regard, a notch 116 is formed in the sidewall of the tube 110. Notch 116 flexes so as to temporarily reduce the diameter of the inlet 114 as the tube 110 is mated, by way of interference-fit, with the opening formed in the container 140 and, in some embodiments, with the through-hole formed in closure body 120 when the seal 126 is removed by way of pulling/removing pull ring 124. The seal 126 may be foil, perforated plastic panels, or other similar elements that create a seal to retain fluids within the container 140.

Closure body 120 includes an opening/outlet that is revealed by removing blocking piece 126 via pull ring 124. When used in conjunction with container 140, body 120 may have a conventional screw-top fitting to attach to the container. Alternatively, tube 110 can be inserted directly into the neck opening of the container 140 itself. In either instance, flange 112 and fitting 113 cooperate to create a fluidic seal between the container 140 and the tube 140.

Notably, the inlet 114 has a section with a reduced thickness sidewall. The outer circumference of this section is smooth so as to create an effective seal between the tube 110 and the container 140 (or closure 120). To that end, flange 113 acts as a stopper during the insertion process, while fitting 113 includes a bead along the outer circumference that engages and fits concentrically within the neck opening/through hole (either on the container 140 or the closure body 120).

Preferably, a plurality of protrusions are provided to ensure a secure fit. In fact, this arrangement has been found to be far more resistant to inadvertent leaks and disconnections in comparison to the prior art. Comparative testing against the funnel of U.S. Pat. No. 9,346,658 shows that the inventive assembly is 3 to 5 times more resistant to unwanted rotary forces, as well the leaks and disconnections that flow therefrom.

When present, flange 112 can facilitate fitting the tube 110 into the closure body 120. In particular, flange 112 can serve as stop to prevent over-insertion of the tube, as well as to better effect the snap-fit. Flange 112 may be provided continuous around the entire circumference of the tube, or it may take the form of one or a series of nubs formed on the exterior. A continuous flange will allow for the smooth exterior surface to be carried forward to the terminal edge of the outlet 115 (i.e., effectively, a straight edge when viewed cross-sectionally) for a more pleasing aesthetic.

In a preferred embodiment, the hollow tube is completely devoid any threads, tapping, or similar structures used to effect a screw-fitting. As noted above, this arrangement provides for a significant improvement in securing the tube 110 to the container 140 (by way of the closure body 120).

The tube 110 includes at least one integrally formed connector 130. The connector 130 attaches to or includes a ring 132 that cooperates with the exterior surface of the closure body 120 and/or the edge of the container opening itself to secure the assembly 100 to the container 140. The ring may include inwardly facing features, such as teeth, tabs, roughened surface treatments, and/or other interference-inducing protrusions, to grip the connector 130 to the container 140.

In a preferred embodiment, a pair of members 134 run between the ring 132 and the inlet section of the tube 110 to couple the tube to the container 140. The members 134 are preferably formed as an integral part of the tube 110 along its exterior (e.g., proximate to the inlet 114), although an appropriate connection can be made through the use of a fastener. While two members 134 best ensure that the tube 110 rests flat against the container 140 when the assembly 110 is in its transportable position (i.e., when the tube 110 is not snap-fitted), a single member or a plurality of members can be used.

Separately, a closure body 120 is provided. This closure 120 is specifically formed to seal an opening in the container 140. While a circular shape for the closure 120 and opening are depicted, other shapes (e.g., oval, acircular, etc.) may be employed. The closure 120 itself may be tapped to fit to the container or a force fitting, adhesive fit, snap-fit, or other common techniques can be used.

The closure 120 includes a through-hole or channel that is initially blocked by a removable covering 122. The covering can be a paper or foil seal and/or a pull tab or punch out section of molded plastic. Still other arrangements are possible, but in each case, the removable section 122 covers the through-hole to prevent unintended leakage or loss of fluid from the container 140. A pull ring, tab, flange, or other similar gripping implement 124 may be formed on or attached to the removable covering to facilitate its removal.

When the user desires to dispense fluid from the container, the removable section is dislodged to expose the through-hole. The inlet 114 of the tube is then snap-fitted into place so that the assembly is in an assembled, ready-to-use position. To that end, a locking bead may be formed along the inner facing of the through-hole. Additionally or alternatively, the combination of flange 112 and snap-fitting(s) 113 ensure a matching engagement of the inlet 114 to the through-channel of the closure 120.

Advantageously, the assembly 100 can be formed integrally as a single piece by way of injection or other molding techniques. In this manner, manufacturing is simplified. Further, the assembly 100 can be subsequently fitted to a container or closure of any style or shape, provided that the inlet 114 creates an effective seal with the neck opening/through hole.

All components should be made of materials having sufficient flexibility and structural integrity, as well as a chemically inert nature. The materials should also be selected for workability, cost, and weight. Common polymers amenable to injection molding, extrusion, or other common forming processes should have particular utility, although metals, alloys, composites, and other formable materials may be used alone or in combination.

To that end, the funnel and closure are preferably formed from moldable plastics, while the container itself may be made from any appropriate material. Polypropylene and polyethylene have particular utility, as both are amenable to various injection-molding techniques. Extrusion processes are not preferred, as these may lead to sharp edges that could comprise the sealing of the assembly and/or container. Also, the exclusion of threaded connections will simplify manufacturing and, as such, provides another advantage over the prior art.

U.S. Pat. Nos. 9,266,707 and 9,346,658 are incorporated by reference in their entirety. The latter is particularly pertinent for the purpose of describing injection molding aspects of this invention.

Although the present embodiments have been illustrated in the accompanying drawings and described in the foregoing detailed description, it is to be understood that the invention is not to be limited to just the embodiments disclosed, and numerous rearrangements, modifications and substitutions are also contemplated. The exemplary embodiment has been described with reference to the preferred embodiments, but further modifications and alterations encompass the preceding detailed description. These modifications and alterations also fall within the scope of the appended claims or the equivalents thereof.

What is claimed is:

1. A container comprising:

a container body enclosing a flowable product and having a neck opening on its top end; and a funnel apparatus having A ringed connector detachable to an outer surface of the neck opening and a hollow tube rotatably attached to the ringed connector wherein the an inlet end of the hollow tube has a notched edge and is received within an inner diameter of the neck opening and wherein the inlet end includes an engagement bead and a stopper, said engagement bead and stopper cooperating to maintaining an interference fit within the neck opening; and wherein an outer circumference of the inlet end between the engagement bead and the stopper has a smooth surface creating a seal with the neck opening.

2. The container according to claim 1 wherein the hollow tube has sidewalls of reduced thickness proximate to the outer circumference, said reduced thickness in comparison to sidewalls formed axially adjacent thereto in the hollow tube.

3. A container comprising:

a container body enclosing a flowable product and having a neck opening on its top end;

a funnel apparatus having a ringed connector detachable to an outer surface of the neck opening and a hollow tube rotatably attached to the ringed connector wherein the an inlet end of the hollow tube has a notched edge and is received within an inner diameter of the neck opening and wherein the inlet end includes an engagement bead and a stopper, said engagement bead and stopper cooperating to maintaining an interference fit within the neck opening; and wherein the notched edge imparts sufficient resilience for the inlet end to have a temporarily reduced diameter when the hollow tube is inserted into the neck opening.

4. A container comprising:

a container body enclosing a flowable product and having a neck opening on its top end;

a funnel apparatus having a ringed connector detachable to an outer surface of the neck opening and a hollow tube rotatably attached to the ringed connector wherein the an inlet end of the hollow tube has a notched edge and is received within an inner diameter of the neck opening and wherein the inlet end includes an engagement bead and a stopper, said engagement bead and stopper cooperating to maintaining an interference fit within the neck opening;

wherein the hollow tube has an outlet end opposite to the inlet end; and wherein a sidewall thickness of the hollow tube gradually tapers from a point of greatest thickness at the stopper to a thinner point proximate to the outlet end.

5. The container according to claim 4 wherein the taper of the tube is less than 1.0 degrees relative to a central, elongated axis of the hollow tube.

6. The container according to claim 5 wherein an outer surface of the hollow tube is smooth between the stopper and the outlet end.

* * * * *